US006916153B2

(12) United States Patent
Boening

(10) Patent No.: US 6,916,153 B2
(45) Date of Patent: Jul. 12, 2005

(54) GUIDING GRID OF VARIABLE GEOMETRY AND TURBOCHARGER

(75) Inventor: Ralf Boening, Bad Kreuznach (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/659,786

(22) Filed: Sep. 10, 2003

(65) Prior Publication Data

US 2004/0081567 A1 Apr. 29, 2004

(30) Foreign Application Priority Data

Sep. 10, 2002 (EP) ..... 02020412

(51) Int. Cl.[7] ..... F01D 25/24

(52) U.S. Cl. ..... 415/163; 415/206; 415/213.1

(58) Field of Search ..... 415/160, 163, 415/164, 165, 206, 213.1

(56) References Cited

U.S. PATENT DOCUMENTS 4,657,476 A * 4/1987 Berg ..... 415/48

* cited by examiner

*Primary Examiner*—Ninh H. Nguyen
(74) *Attorney, Agent, or Firm*—Pendorf & Cutliff; Grey Dziegielewski

(57) ABSTRACT

A guiding grid of variable geometry comprises a plurality of guiding vanes in a housing in angular distances around a central axis in an axially extending vane space of a predetermined axial distance. Each vane is pivotal about an associated pivoting axis to assume different angles in relation to the central axis and, thus, to form a nozzle of variable cross-section between each pair of adjacent vanes. A nozzle ring supports the vanes around the central axis and forms a first axial limitation of the vane space. A unison ring is displaceable relative to the nozzle ring and is connected to the vanes to pivot them. An annular disk is fixed to the housing and faces the nozzle ring in an axial distance to form a second axial limitation of the vane space and a central opening. Into this opening, a sleeve may be inserted. A fixing arrangement determines the axial position of the annular disk with respect to the housing.

10 Claims, 2 Drawing Sheets

GUIDING GRID OF VARIABLE GEOMETRY AND TURBOCHARGER

CROSS REFERENCE TO RELATED APPLICATION

This application is based upon European Patent Application No. 02 020 412,9, filed Sep. 10, 2002, from which priority is claimed.

FIELD OF THE INVENTION

The present invention relates to a guiding grid or actuator of variable geometry, particularly for a turbine housing having a central outlet pipe. More particularly, the invention relates to a guiding grid which comprises a plurality of guiding vanes arranged in angular distances about a central axis in an axially extending vane space of a predetermined axial distance, each vane being pivotal about an associated pivoting axis to assume different angles in relation to the central axis and, thus, to form a nozzle of variable cross-section between each pair of adjacent vanes. A generally annular nozzle ring for supporting the plurality of pivoting vanes around the central axis forms a first axial limitation of the vane space. A displaceable unison ring is placed around the central axis relative to the nozzle ring in order to vary the geometry of the guiding grid. The unison ring is connected to the vanes in order to pivot them when being displaced to adjust their respective angular position in relation to the central axis. Mechanical interconnections of a unison ring and the vanes are known in the art and can be formed by levers arranged in a rayed configuration and fastened to shafts of the vanes or by gears or any other means known in the art; in any case, the present invention is not restricted to one of these interconnections.

Furthermore, the present invention relates to a turbocharger including a guiding grid and further comprising a turbine housing and a releasably attachable bearing housing for supporting a turbine shaft.

BACKGROUND OF THE INVENTION

Guiding grids of the above-mentioned kind have become known by a multitude of documents, such as U.S. Pat. Nos. 4,179,247 or 5,146,752. U.S. Pat. No. 5,146,752, in particular, illustrates how laborious it is to mount the individual parts of the guiding grid in the housing, since various parts have to be matched, patched and fitted with one another and have to be interconnected, particularly when inserting them into a turbine unit or a turbocharger. It is clear, that such a construction is expensive.

SUMMARY OF THE INVENTION

It is an object of the present invention to provide a guiding grid of the kind described at the outset which is easy to assemble and can quickly be mounted.

A further object is to reduce mounting expenses by providing a simple and compact construction.

These objects are achieved according to the invention in two steps, i.e. first by providing a part (preferably in the form of an annular disk) fixed to the housing, that faces the nozzle ring, and is in an axial distance which corresponds to a predetermined axial distance from the nozzle ring so as to form a second axial limitation of the vane space. As a second step, a sleeve can be inserted into the central opening which comprises a fixing arrangement for determining the axial position of that part or disk with respect to said housing. In this way, the sleeve can be inserted together with the guiding grid as a pre-mounted module into the central opening such that the module can be fastened afterwards.

Such a module is particularly beneficial if an annular disk (or disk like body) is provided in a "cartridge" together with the remaining parts of the guiding grid so that the whole preassembled unit can be inserted into a turbine housing. In such an assembly, mounting is considerably simplified and accelerated because mounting is to the annular disk, and not directly to a wall of the turbine housing In principle, mounting can be effected so that the sleeve is only frictionally fixed in the central opening. However, mounting can be done by providing at least one driver flange facing the side of the vanes to plug the sleeve into the central opening of the housing (particularly when providing an annular disk). Preferably, instead of having one or a plurality of peripherally distributed driver flanges, the driver flange will be formed by a radially extending flange of the sleeve which engages the disk at the side of the vane space.

The invention also relates to a turbocharger having a guiding grid which comprises a turbine housing and a bearing housing that is releasably attached to the turbine housing and supports the turbine shaft. When mounting the guiding grid, the fact that the bearing housing being releasably attached to the turbine housing allows easy access to the interior of the turbine housing and to a wall surrounding the central opening. Such a turbocharger is characterized by a plug connection for interconnecting the wall of the turbine housing and the guiding grid, thus defining the angular position in peripheral direction of the guiding grid relative to said housing (to avoid any turning movement), while the fixing device defines the axial position of the guiding grid. In this way, the guiding grid is quickly and precisely fastened to the turbine housing.

BRIEF DESCRIPTION OF THE DRAWINGS

Further details of the invention will become apparent from the following description of a preferred embodiment of the invention schematically illustrated in the drawings in which.

DETAILED DESCRIPTION OF THE INVENTION

Figure 1:
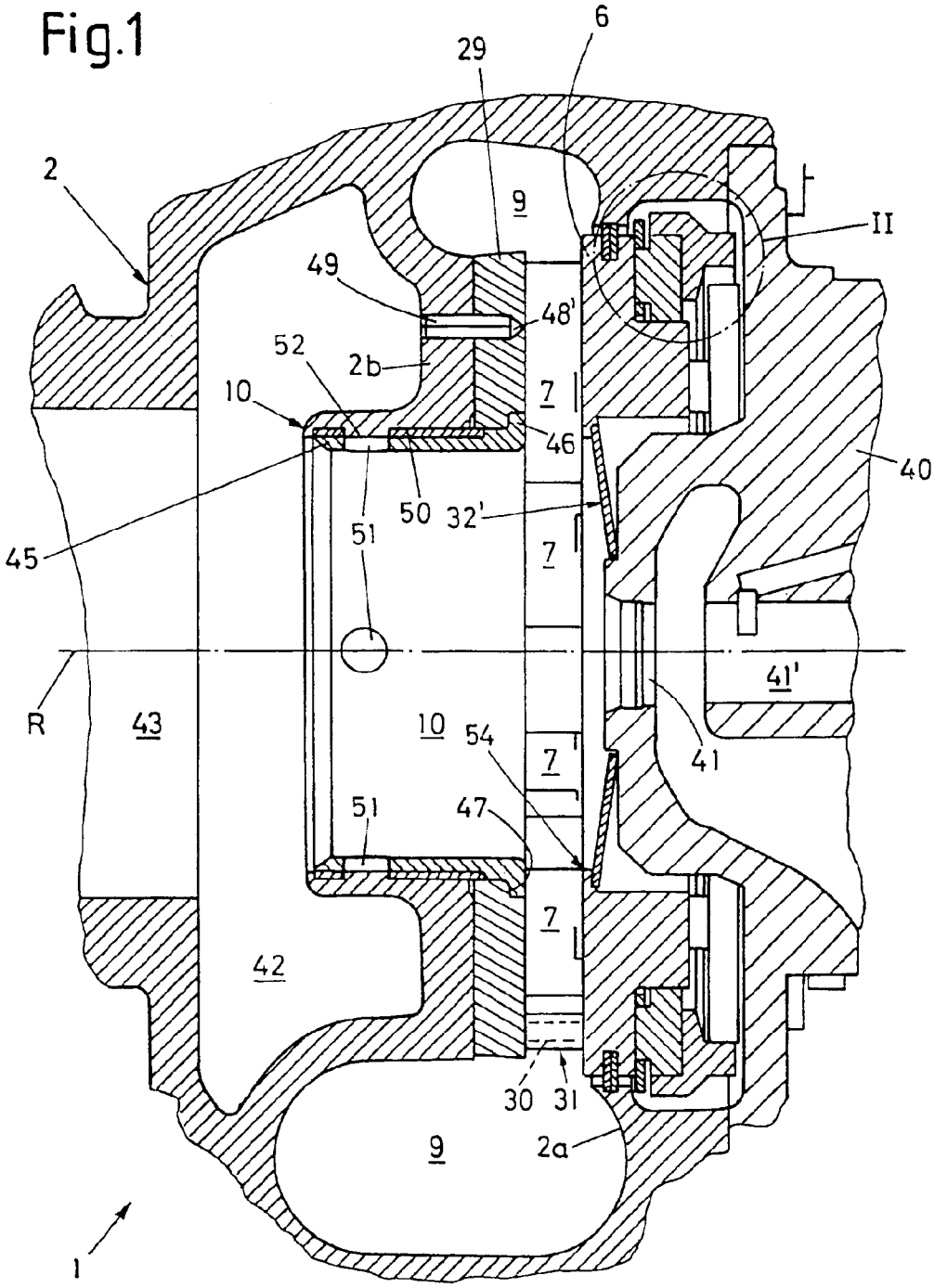
FIG. 1 is an axial cross-section of the transitional region between turbine housing and bearing housing of a turbocharger where the guiding grid according to the invention is accommodated.

In FIG. 1, a part of a turbine housing 2 of a turbocharger 1 is represented which, typically, comprises a peripheral supply channel 9 for a fluid spirally wound around a central axis R, the fluid being of any nature, even liquid, but in case of a turbocharger supplying exhaust gas of a combustion motor as is known (not shown). This fluid is then supplied in radial direction through a plurality of guiding vanes 7 arranged around the central axis R to a turbine rotor (not shown) rotating about the central axis R. This turbine rotor is mounted, as is known, at the end of a rotor shaft (also not shown) which is supported in bearings 41 and 41' situated within a bearing housing 40 that is releasably attached to the turbine housing 2 and fastened to it by bolts not shown. In the case of a turbocharger, this shaft extends through this bearing housing 40 to a compressor rotor located within a compressor housing that is either releasably attached to the bearing housing or may be integrally formed with it. This compressor may be driven in a known manner by the turbine wheel in the turbine housing via the common shaft, thus being driven by the exhaust gases supplied to the turbine housing 2.

Figure 2:
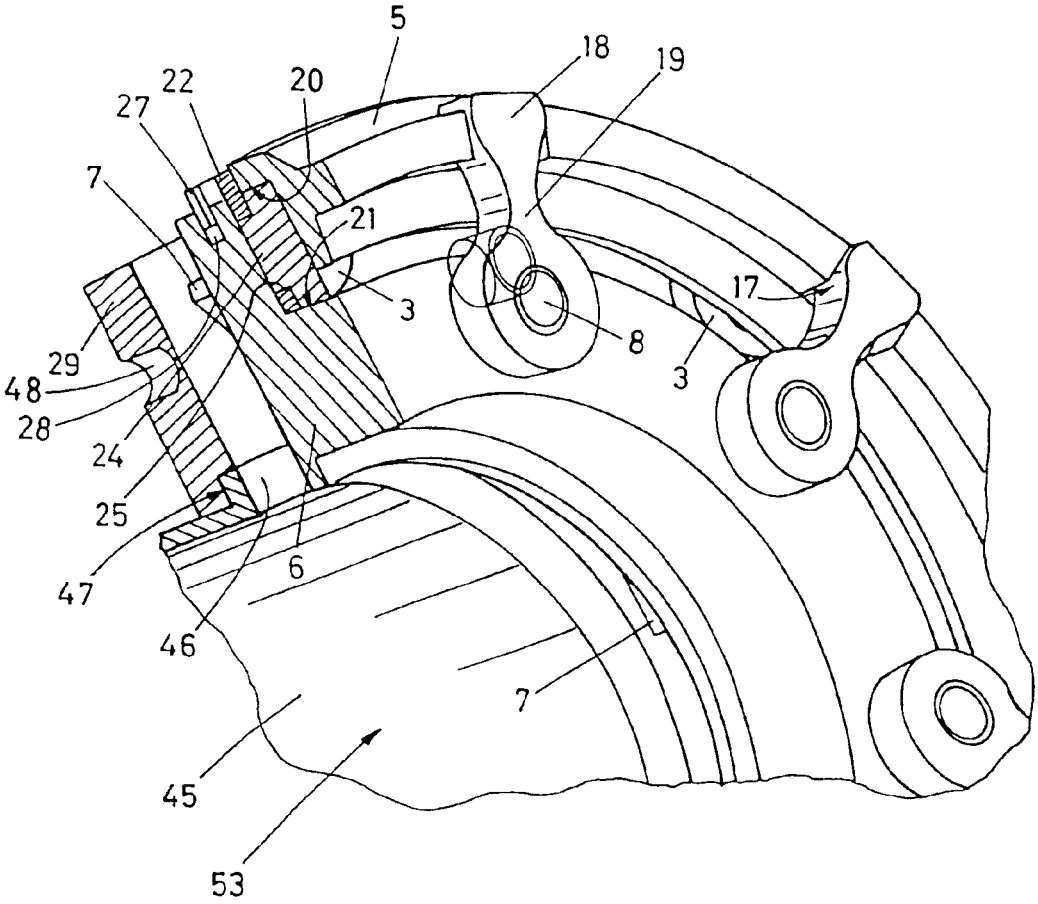
FIG. 2 is a partial, perspective view of the guiding grid illustrating detail II of FIG. 1 at a larger scale.

It has already been stated that it is known to make the guiding vanes 7, which form a generally circular guiding grid, adjustable, thus conferring a variable geometry to the guiding grid in such a manner that the vanes 7 are either pivoted to be inclined towards the central axis R in a more radial direction or to extend approximately tangentially. FIG. 2 illustrates these conditions and shows an antifriction bearing having rolling bodies in the form of rollers 3 between a unison or adjusting ring 5 and a nozzle ring or vane support ring 6 in which adjusting shafts 8 forming pivoting axes of the guiding vanes 7 are supported. Turning and adjusting the adjusting shafts 8 and of the unison ring 5, that actuates them, may be done in a known manner as described in U.S. Pat. No. 4,659,295 mentioned above. In any case, the methodology described in the present invention causes a turning movement of the unison ring 5 to pivot relative to the stationary nozzle ring or vane supporting ring 6 which provokes a corresponding pivoting motion of the adjusting shafts 8.

The free lever ends or heads 18 of adjusting levers 19 are held in grooves or recesses 17 of the unison ring 5 and fastened or connected to the adjusting shafts 8,. Note that in addition to through-passing recesses 17, the grooves could also be provided at the inner radial side of the unison ring 5, as is known, wherein the heads 18 are held so that the heads 18 ensure a pre-centering of the unison ring. Further, it is clear that this is but one of a variety of possible embodiments, and that an adjustment can also be effected and transmitted by slot cams or interengaging gear teeth.

In this way, exhaust gas of a combustion motor, supplied via the supply channel 9, is supplied to a higher or lower extent to the turbine rotor (not shown) which rotates in the interior of the guiding grid formed by the vanes 7, before the gas is discharged through a pipe 10 extending in axial direction along the central axis R. This discharge pipe 10 is, in the embodiment shown, decoupled from a following continuation 43 by a decoupling space 42, but can, if desired, be directly connected to an exhaust system.

The unison ring 5 has a radially inwards directed rolling surface 20 where the rollers 3 can roll. Preferably, however, this is only provided for compensating tolerances, because in practice it will be preferred if the rollers 3 have a certain play under all operational circumstances both with respect to this rolling surface 20 and in relation to an opposite exterior roller surface 21 of the nozzle ring 6 which forms a shoulder.

As shown in FIG. 2, relatively few rollers 3 will be necessary if a cage ring or holding ring 22 is utilized. Although the rollers could also run in recesses of this holding ring 22, it is advantageous if the rollers 3 have axial projections 24 of a smaller diameter which engage holes 25 of the holding ring 22 so that the latter provides an appropriate distance in a peripheral direction on the one hand, while holding and maintaining the rollers 3 firmly in axial direction on their track with respect to the rolling surfaces 20 and 21.

A sealing ring 27 may be inserted into a sealing groove 28 of the nozzle ring 6. When comparing FIGS. 1 and 2, the nozzle ring 6 is situated in the region of a housing wall portion 2*a*. In principle, various sealing arrangements are conceivable: Either the sealing ring 27 is formed as a flexible sealing lip engaging the wall 2*a*. This, in general, would present no problems, because these parts should not move relative to one another during operation. However, it would also be possible that an additional sealing ring or the sealing ring 27 shown could project into a groove of the wall 2*a*, thus forming a kind of labyrinth sealing, and even a combination of both possibilities or an approach known in the art of sealings is conceivable. In any case, this sealing serves to keep dirt and pollution material away from the antifriction bearing 3, 20, 21, stemming from the region of the supply channel 9.

In a distance defined by spacers 31 arranged on the nozzle ring around the central axis R, a fastening disk 29 is provided which abuts to to the turbine housing 2 in the region of a housing flange 2*b* best seen in FIG. 1. The fastening disk 29 is fastened to the nozzle ring 6 by way of bolts 30, indicated by dotted lines, which extend, for example, through spacers 31, the spacers 31 providing a somewhat larger space than would correspond to the width of the vanes 7 in axial direction, as is known, in order not to impede their pivoting movement at all temperature ranges. In this way, the guiding grid as shown in FIG. 2 can readily be pre-assembled to be inserted into the turbine housing 2.

In order to be able to insert the module thus created into the turbine housing 2 in a quick and precise way, it is connected to a sleeve 45 insertable into the central axial pipe 10 and having a central opening 53 so that this sleeve, in principle, needs only to be inserted into this discharge pipe 10. To facilitate this, the sleeve 45 has at least one flange 46 which engages and brings with it the disk 29, and thus preferably the whole guiding grid module, when being inserted into the discharge pipe 10, thus determining the axial position of the module. If in this context the term "at least one driver flange" 46 is used, it should be understood that it would be possible to provide a plurality of driver flange-like claws or projections protruding in radial direction, particularly distributed in equal angular distances. However, it is preferred, if, as shown in FIG. 2, the driver member is formed as a driver flange 46 which extends in radial direction from the sleeve and grasps behind the disk 29 at the side of the vanes and the vane space, although it would, in principle, also be possible to have radially interengaging projections and recesses of the disk 29 and the sleeve 45.

Particularly from FIG. 1 it can be seen that it is advantageous if the disk 29 has at least one recess 47 adjacent the central opening. This recess 47 is engaged by at least one driver flange member 46 preferably so that the driver flange's surface towards the vane space is flush and aligned with that surface of the disk 29 that faces the nozzle ring 6. In the case explained above where a plurality of radial projections are distributed over the circumference of the sleeve 45, a plurality of corresponding recesses distributed over the circumference could be provided. In this way, fixing of the guiding grid module against any rotation about the central axis R could be effected at the same time. However, machining several individual and precise recesses into the sleeve 45 is more difficult to produce, for which reason it is preferred it the recess 47 is formed as a groove extending in peripheral direction of the sleeve 45 (see FIG. 2). FIG. 1 shows clearly that with equal axial width of the groove 47 and the driver flange 46, the latter is flush with the surface of the disk 29 so that flow conditions in the vane space, i.e. in the region of the vanes 7, are not affected. Of course, an annular groove 47 could also be used if the sleeve 45 had several individual projections as driver flange members arranged in an angular distance from one another, but this could result in disturbing the flow of exhaust gas streaming to the vanes 7 and the turbine rotor situated within the circle of vanes which form the guiding grid.

For fixing the module in peripheral direction, preferably a bore 48 (FIG. 2) and/or 48' (FIG. 1) is provided in the disk 29 which receives a pin (or bolt) mounted in the turbine housing 2, i.e. in the wall 2*b*. It has already been pointed out above that fixing in peripheral direction against turning of the disk 29 could also be provided by at least one recess and a corresponding projection. According to another alternative, the arrangement could be reversed so that the disk 29 comprises a, p.e. integral, pin inserted into a hole of the wall 2*b*. Furthermore, fixing in peripheral direction could also be effected by way of threaded bolts, although this is not preferred due to the resulting higher working and mounting expenses.

In the embodiment shown, the turbine housing 2 is machined in such a way that inserting the sleeve 45 is effected by screwing it by way of a thread 50. Therefore, an inner thread (corresponding to thread 50) has to be cut into the axial pipe 10 into which a corresponding outer thread of the sleeve can be screwed. In principle, axial determination of the position of the disk 29 can be ensured as soon as the disk 29 engages and abuts the, preferably parallel, wall 2*b*. However, vibrations during operation can result in loosening the thread connection. Therefore, it may be desired to weld the sleeve 45 to the wall 2*b* either as an alternative or in addition. Another alternative can consist in press fitting and/or plastically deforming the sleeve 45 when inserting it into the axial pipe 10.

Furthermore, it is convenient to provide a heat shield 32' between the bearing housing 40 and the vane space surrounded by the guiding grid and vanes 7. This heat shield props, in this embodiment, against a surface of the guiding grid, on the one hand, which surface is preferably provided on the nozzle ring 6. To this end, the nozzle ring 6 may have at least one radially inwards directed (with respect to the central axis R) projection 54. As in the case of the above-mentioned recesses, it would also be possible to provide a plurality of projections 54 distributed over the inner circumference of the nozzle ring 6, but for production reasons it is preferred to arrange a radially inwards directed flange as the projection 54. On the other hand, the heat shield engages and props against a wall of the bearing housing 40, as is shown in FIG. 1. Of course, other configurations and arrangements are also possible.

This is also merely one of a variety of different possible embodiments. For it would equally be possible to use other known means for securing the thread 50, such as a counter nut (e.g. in form of a threaded sleeve), which may be screwed, when seen in FIG. 1, at the left side. Another possibility could consist in screwing a clamping screw into the axial pipe 10 which protrudes as a projection towards the interior of the pipe 10 and clamps the sleeve 45 securely. Furthermore, it would be possible to provide other projections (as indicated at 52 in FIG. 1) which engages a recess 51 (either formed as a through-hole, as in FIG. 1, or being only in the outer surface of sleeve 45 in order to determine the axial position of the sleeve 45 and the guiding grid with vanes 7. This latter approach will be difficult if a rigid sleeve 45 is used, but it would be possible to form the left end of the sleeve 45 (with respect to FIG. 1) as springy tongues which, for example engage corresponding axial grooves of the discharge pipe 10, and which may be latched into appropriate snap-in projections (or vice-versa: at least one snap-in projection being provided on a tongue to snap into a hole of the axial pipe 10). In principle, however, the recesses 51 may be conveniently provided to engage an appropriate tool when mounting.

A further possibility within the scope of the present invention could reside in determining the final position of a guiding grid module by an adjusting arrangement rather than by the surface of the wall 2*b*. For example, at least one adjusting screw, preferably several ones, could be screwed into the wall from the left side (with respect to FIG. 1) to determine with their right-hand end (as an abutment) that plane where the disk 29 should lie.

Reference Number List

| | | | |
|---|---|---|---|
| 1 | Turbocharger | 2 | Turbine housing |
| 3 | Rollers | 4 | Bearing housing |
| 5 | Unison ring | 6 | Nozzle ring |
| 7 | Guiding vanes | 8 | Adjusting shafts |
| 9 | Supply channel | 10 | Pipe |
| 17 | Recesses | 18 | Heads |
| 19 | Adjusting levers | 20 | Rolling surface |
| 21 | Exterior roller surface | 22 | Cage ring |
| 23 | | 24 | Axial projections |
| 25 | Holes | 26 | |
| 27 | Sealing ring | 28 | Sealing groove |
| 29 | Disk | 30 | Bolts |
| 31 | Traversing sleeves | 32' | Heat shield |
| 40 | Bearing housing | 41, 41' | Bearings |
| 42 | Decoupling space | 43 | Following continuation |
| 44 | Spacer | 45 | Sleeve |
| 46 | Driver flange | 47 | Recess |
| 48 | Bore | 49 | Pin |
| 50 | Thread | 51 | Recess |
| 52 | Projections | 53 | Central opening |
| 54 | Nozzle ring projection | | |

What is claimed is:

1. A guiding grid of variable geometry comprising:

a turbine housing (2) including an axial outlet pipe (10);

a plurality of guiding vanes (7) arranged in said housing (2) in angular distances around a central axis (R) in an axially extending vane space of a predetermined axial distance, each vane (7) being pivotal about an associated pivot axis (8) in relation to said central axis (R) to form a nozzle of variable cross-section between each pair of adjacent vanes (7);

a generally annular nozzle ring (6) for supporting said vanes (7) for pivoting about their respective said pivot axis (8), said nozzle ring (6) forming a first axial limitation of said vane space;

a unison ring (5) pivotable around said central axis (R) relative to said nozzle ring (6), said unison ring (5) being operatively connected to said vanes (7) in order to pivot said vanes (7) about their pivot axis (8) when said unison ring (5) is pivoted;

a disk (29) with a central opening, said disk connected to and spaced from said nozzle ring (6) at an axial distance corresponding to said predetermined axial distance relative to the central axis (R) to form a second axial limitation of said vane space, and a sleeve (45) extending through said disk (29) central opening, engaging said disk (29), and extending into and attaching to said turbine housing axial outlet pipe (10) thereby fixing the guiding vanes (7), nozzle ring (6) and disk (29) to the turbine housing (2).

2. The guiding grid according to claim 1, wherein said sleeve (45) includes at least one engaging piece engaging said disk (29) for securing said disc to said turbine housing (2).

3. The guiding grid according to claim 2, wherein said engaging piece comprises a radially extending flange (46) which engages said disk (29) at the side of the disk facing said vane space.

4. The guiding grid according to claim 3, wherein said disk comprises at least one recess for receiving and engaging said flange (46).

5. The guiding grid according to claim 3, wherein said flange (46) closes off the surface of the disk (29).

6. The guiding grid according to claim 5, wherein said disk (29) comprises at least one annular recess and wherein said flange (46) is an annular flange.

7. The guiding grid according to claim 6, wherein said recess has an axial dimension to allow said flange (46) to be aligned with said surface of said disk which faces said nozzle ring (6).

8. The guiding grid according to claim 1, wherein said housing (2) comprises a wall extending substantially perpendicular to said central axis (R), said wall being substantially parallel to said disk (29), the guiding grid further comprising fastening means for interconnecting said wall and said disk.

9. A turbocharger comprising:

a shaft extending along a central axis (R);

a turbine wheel mounted on said shaft;

a turbine housing (2) for housing said turbine wheel in a turbine space of said turbine housing including:

a peripheral supply channel for allowing exhaust gas to enter said turbine space and to drive said turbine wheel, a central discharge pipe (10) which extends along said central axis (R) and forms an opening of said turbine space, and a wall surrounding said opening;

a bearing housing (4) releasably attached to said turbine housing for supporting said shaft;

a plurality of guiding vanes (7) arranged in said turbine housing in angular distances around said central axis (R) in an axially extending vane space of a predetermined axial distance, each vane (7) being pivotal about an associated pivot axis in relation to said central axis CR) to form a nozzle of variable cross-section between each pair of adjacent vanes (7);

a generally annular nozzle ring (6) for supporting said vanes (7) around said central axis (R), said nozzle ring (6) forming a first axial limitation of said vane space;

a unison ring (5) pivotable around said central axis (R) relative to said nozzle ring (6), said unison ring (5) being operatively connected to said vanes (7) in order to pivot said vanes (7) about their pivot axis (8) when said unison ring (5) is pivoted;

a disk (29) with a central opening, means for connecting said disk (29) to said nozzle ring (6) at an axial distance corresponding to said predetermined axial distance relative to the central axis (R) to form a second axial limitation of said vane space, and a sleeve inserted through said opening in said disk (29) and into said central discharge pipe (10) and having means for engaging said a central discharge pipe (10) and means for engaging said disk (29) to thereby secure said guiding vanes (7), nozzle ring (6) and disk (29) to said turbine housing (2).

10. The turbocharger according to claim 9, further including indexing means for indexing the angular position of said disk (29) and guiding vanes (7) relative to said turbine housing (2) during assembly, wherein said indexing means is an element (49) extending through bores (48') in said disk (29) and to said housing (2).

* * * * *